United States Patent [19]

Pietrowski

[11] Patent Number: 4,603,560

[45] Date of Patent: Aug. 5, 1986

[54] APPARATUS FOR REMOVING SNAGS FROM FABRIC

[76] Inventor: Eugene E. Pietrowski, 153 Cooper Ave., Iselin, N.J. 08830

[21] Appl. No.: 606,521

[22] Filed: May 3, 1984

[51] Int. Cl.[4] ..... D04B 3/00

[52] U.S. Cl. ..... 66/1 R; 223/102; 66/1.5

[58] Field of Search ..... 66/1 R, 1.5, 2, 117; 112/225; 139/1.5; 223/1, 99, 102

[56] References Cited

U.S. PATENT DOCUMENTS

| | | | |
|---|---|---|---|
| 1,756,294 | 4/1930 | Leavin | 66/1.5 |
| 2,416,260 | 2/1947 | Karle | 223/99 X |
| 2,586,733 | 2/1952 | Sologaistoa | 66/117 |
| 2,673,574 | 3/1954 | Gottlieb | 223/99 X |
| 3,404,707 | 10/1968 | Feld | 223/99 X |

FOREIGN PATENT DOCUMENTS

| | | | |
|---|---|---|---|
| 673228 | 3/1939 | Fed. Rep. of Germany | 66/1.5 |
| 492130 | 3/1954 | Italy | 66/1.5 |
| 344145 | 3/1931 | United Kingdom | 223/99 |
| 779671 | 7/1957 | United Kingdom | 223/102 |

OTHER PUBLICATIONS

Knitting Times, Mar. 13, 1972, pp. 44, 45, 80.

*Primary Examiner*—Wm. Carter Reynolds
*Attorney, Agent, or Firm*—Ezra Sutton

[57] ABSTRACT

The invention features an apparatus and method for extracting snags from fabric. The apparatus comprises a barrel-shaped housing having a plurality of extracting elements slideably disposed therein. The user of the device can select the proper extractor for the particular fabric. The device is compact and easy to use. The method of the invention requires that the extractor pierce the fabric from the underside; capture the snag in an extracting loop; twisting and entwining the snag in the loop; and then withdrawing the loop in order to pull the snag through the fabric to the underside thereof.

12 Claims, 11 Drawing Figures

FIG. 1
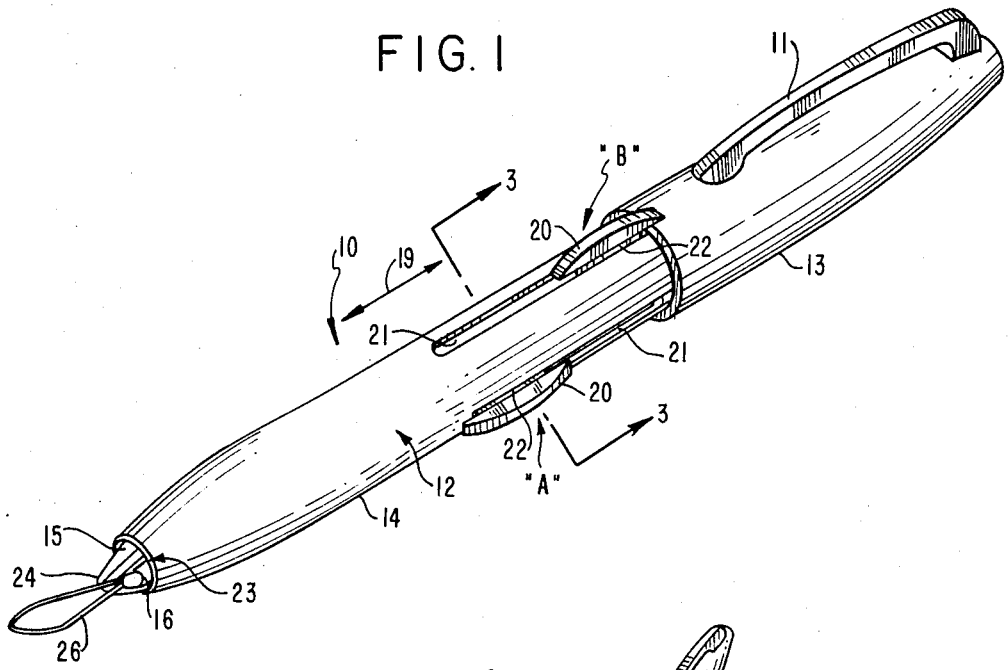
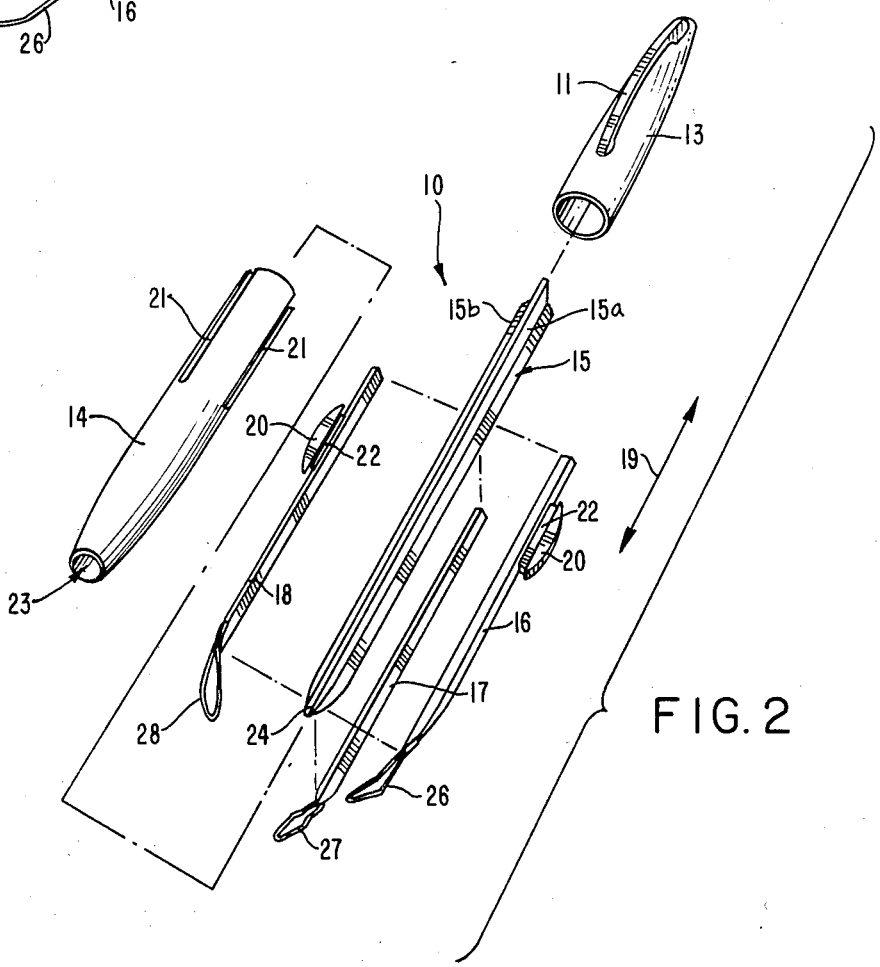
FIG. 2

APPARATUS FOR REMOVING SNAGS FROM FABRIC

FIELD OF THE INVENTION

This invention relates to an apparatus and method for removing snags from fabric, and more particularly, to a novel device and method for selecting the proper extracting tool with respect to the type of fabric and extracting the snag from the fabric in an easy and facile manner.

BACKGROUND OF THE INVENTION

The removal of snags from fabrics is generally not an easy task. If the material is very fine, it is particularly difficult to pull the snagged thread through the fabric. Few commercial tools are available for performing this task. Typically, different tool sizes and shapes are required for different fabric materials.

It is an object of the present invention to provide a single device having a plurality of different snag extracting tools built in to the device in a compact and easy-to-use manner.

It is another object of this invention to provide a new method of extracting snags which is convenient to perform, and which performs the extraction in a more efficient and facile manner.

One of the advantages of the inventive device is the ability of the user to quickly select and use the proper tool for the type of fabric. The compact nature of the device allows for easy storage in the pocket of a user, and in fact, the device may be designed to have the outward appearance of a fountain pen, complete with a pocket clip.

DISCUSSION OF RELATED ART

It is known in the art to have hand tools for repairing runs in knitted fabric. Such a tool is shown in U.S. Pat. No. 1,756,294, issued on Apr. 29, 1930.

While such a tool depicts several needles for engaging threads, with the needles being slidably engageable, this is the only similarity to the invention. This prior art device engages several needles at any one time, with the capability of rendering some of the needles ineffective. There is always one fixed needle in the device.

By contrast, the inventive device operates in a different fashion to the aforementioned tool. The inventive device does not have a fixed needle, and only one needle is operative at any one time. The user of this invention can select which of the different extractors to use for a particular fabric. This selection capability is unique with this invention, but is not the only novelty.

SUMMARY OF THE INVENTION

The invention pertains to a device and method for removing snags from the surface of a fabric.

The device has means for selecting the proper extraction tool for the particular fabric type.

The device comprises a hollow housing having an opening on a distal end. A guide member is disposed within said housing and acts to guide the movement of any one of a plurality of spaced-apart slide members toward the opening in the housing. The slide members are each movable between a retracted and an operable position. Each slide member has a snag extractor on its distal end. The selected snag extractor protrudes from the opening in the housing when its corresponding slide member is in the operable position. However, only one slide member is in an operable position at any one time, and hence, only one snag extractor protrudes from the housing opening.

The guide member is an elongated rod having a plurality of guide channels defined by vanes that abut against an inner surface of the housing to provide structural support to the housing, particularly when the housing wall is thin.

The snag extractors are each different, being designed for different fabrics, but each comprises a wire loop.

In the method of the invention, the proper extractor, i.e., wire loop, is selected, and the fabric is pierced at a point adjacent the snag. The looped wire is extended over the snag in order to capture and engage it. The extractor is then twisted for the purpose of entangling the snag with respect to the extractor loop and then removed from the fabric, whereby the snag is pulled through the fabric to the opposite side.

The slide members of the device comprise elongated rods having selector knobs that protrude through slots in the housing. The knobs are engageable by a user's thumb or finger, such that the slide members can be pushed to an operable position, or to a retracted position.

The guide member is tapered to a rounded tip or point at its distal end, which is useful in parting the fabric weave for easy piercing of a given extractor tool. The rounded tip of the guide member protrudes through the opening in the housing and guides the extractor as it is moved relative thereto.

The wire looped extractors are typically bent about their mid-portion, so that when they are extended over the snag, they will easily engage with it. For fine material snags, the wire loop is substantially diamond-shaped. For larger or coarser materials, the wire loop is substantially oval-shaped.

BRIEF DESCRIPTION OF THE DRAWINGS

FIG. 1 is a perspective view of the snag-removing device of this invention;

FIG. 2 is an exploded view of the device of FIG. 1 illustrating the internal parts;

DETAILED DESCRIPTION OF THE INVENTION

Figure 3:
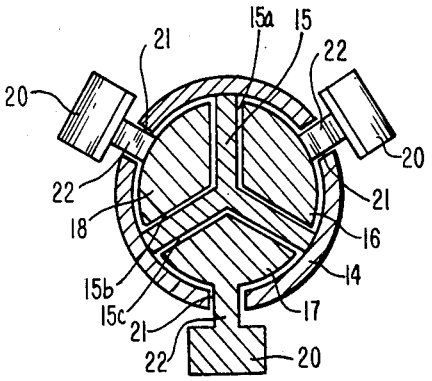
FIG. 3 is a sectional view taken along lines 3—3 of FIG. 1.

Generally speaking, this invention features a device and method for easily and efficiently removing snags from the surface of a variety of materials. The device has a plurality of different extracting tools, so that the right tool may be quickly and easily selected for the right type of fabric. Shaped like a fountain pen, the device is compact and easily stored in the user's pocket.

Now referring to FIG. 1, the snag-removing device 10 is shown in perspective. As aforementioned, the device is shaped like a fountain pen for convenience of storage upon one's person. However, other shapes are perfectly feasible. The pen-shape does provide a convenient pocket clip 11, as shown.

The device 10 comprises a barrel or housing 12 that is split into an upper section 13 and a lower section 14. The housing 12 is split in order to insert the internal parts, shown in FIG. 2.

The internal parts are comprised of a guide member 15, and three slide members 16, 17, and 18, respectively, which are evenly spaced apart about the guide member 15. For a better visual understanding of the spacial relationship of the internal parts, refer to the sectional view of FIG. 3. The three slide members 16, 17, and 18 are spaced approximately 120 degrees apart.

The guide member 15 includes vanes 15*a*, 15*b*, and 15*c* which define guide channels in which slide members 16, 17, and 18 are slideable.

The slide members 16, 17, and 18 rest on the guide member 15 and are slideable over the guide member 15 in a lateral direction denoted by arrows 19 (FIG. 2).

To accomplish the movement of the slide members 16, 17, and 18, respectively, each is equipped with a protruding knob abutment 20 that is designed to be engageable by the finger or thumb of the user.

These knobs 20 extend via struts 22 from each slide member 16, 17, and 18, respectively, through the housing section 14. Knobs 20 are conveniently disposed on the outer surface of the housing section 14 in order to be actuated. Slots 21 in the housing allow for the lateral movement of the slide members, depected by arrows 19.

The slide members are each movable between an operable position and a retracted position, denoted by designations "A" and "B," respectively; i.e., the forward knob position "A" is operable, and the rearward knob position "B" is retracted.

Each slide member 16, 17, or 18, respectively, has a snag-extracting element at its forward end. The extracting elements are comprised of wire loops 26, 27, and 28, respectively, corresponding to their respective slide members 16, 17, and 18. Each wire loop is different structurally from the other wire loops, such that wire loop 26 is used for fine fabric; wire loop 27 is used on medium fabric; and wire loop 28 is used for coarse fabric.

When a slide member is in the operable ("A") position, its respective wire loop extends through a hole 23 in the forward end of the housing section 14. As shown in FIG. 1, slide member 16 is in the forward, operable "A" position, and hence, its extractor loop 26 projects through hole 23.

Only one slide member 16, 17, or 18 can be in the operable "A" position at any one time, and therefore, only one wire loop 26, 27, or 28 can protrude through hole 23 at any one time. Therefore, the pushing forward of a particular knob 20 will determine which extractor is to be used. In other words, the user of device 10 has a convenient and easy way to select the proper extractor. When the extractor has been used to the satisfaction of the user, knob 20 is pushed rearwardly to retracted position "B," and the extractor is withdrawn to the safety of the inner housing.

OPERATION OF THE SNAG-REMOVAL DEVICE

The operation of the above-mentioned device 10 will be hereinafter explained with reference to FIGS. 4 through 9, which represent sequential views of the snag-extraction method of this invention.

Figure 4:
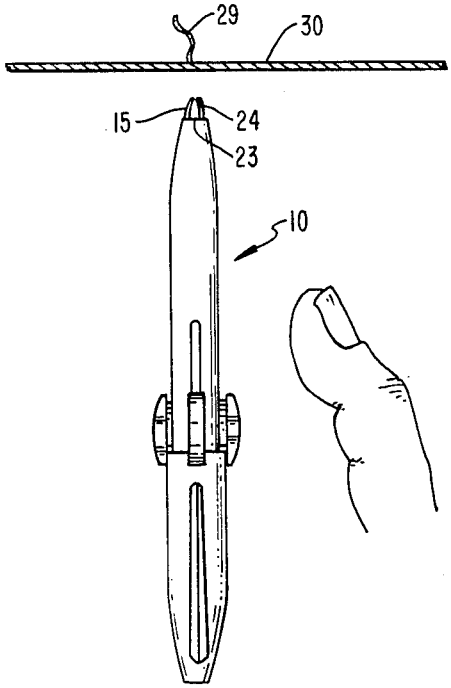
FIGS. 4 through 9 are front sequential views of the device of FIG. 1, depicting the steps of the snag-extracting method.
Figure 5:
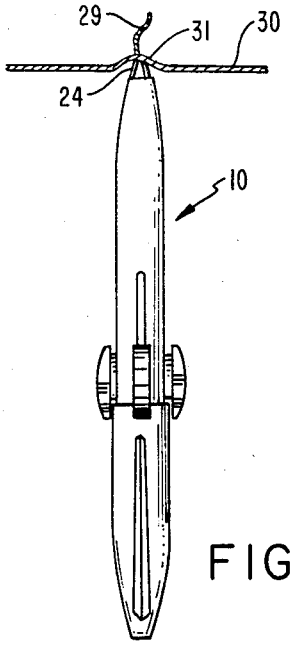

Referring to FIG. 4, device 10 is illustrated as being placed directly adjacent a snag 29 protruding from fabric 30. The guide 15, which always projects through hole 23 of the housing has a tapered point which forms a rounded tip. (See FIGS. 1 and 2.) This tip 24 is placed from below in contact with the fabric 30 about the snag location, as depicted in FIG. 5. A bump 31 is caused to be raised in the fabric 30, and the rounded tip 24 acts to separate the weave of the fabric 30 making insertion of the tool easier. This will also facilitate the capture of snag 29 by the wire-loop extractor 26, 27, or 28, as will be further explained with reference to FIG. 6.

Figure 6:
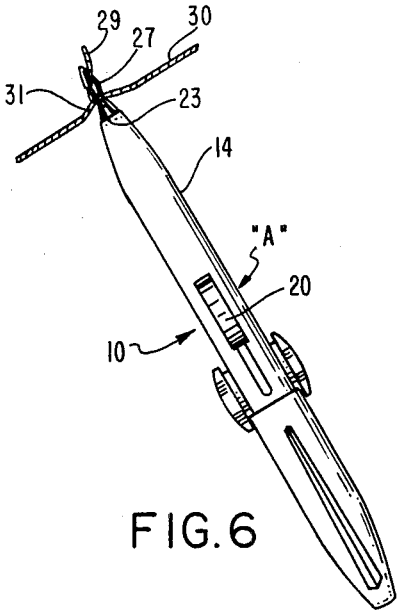

In FIG. 6, knob 20, corresponding to slide member 17, has been pushed to the operable "A" position, as shown, and hence, the wire-loop 27 has been extended from hole 23 of the housing section 14.

The wire-loop 27 has been made to pierce the fabric 30, and is then extended over the snag 29, such that the snag 29 is captured in the inside of the wire-loop 27, as illustrated. This is analogous to threading the eye of a needle.

As aforementioned, the bump 31 raised in fabric 30 by tip 24 assists in the snag capture, since the height of the loop 27 is easily extended over the top of snag 29.

Figure 7:
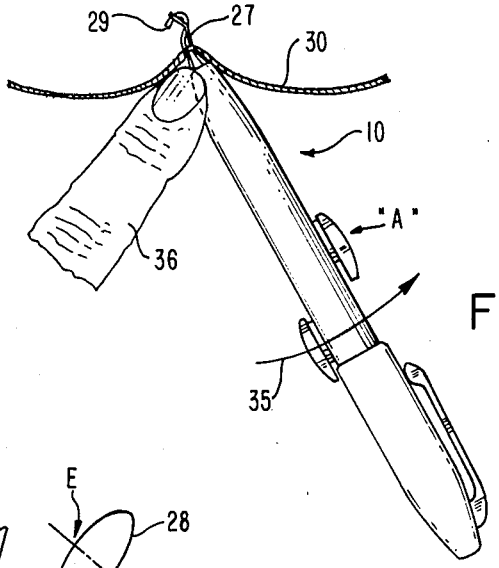

Referring now to FIG. 7, the device 10 is now rotated (arrow 35) in the user's hand, while the user places the finger 36 of his other hand upon fabric 30 as shown, in order to steady the fabric 30 as the extractor 27 is turned.

As the wire-loop extractor 27 is turned via rotation of device 10, the snag 29 is caused to wind upon wire-loop 27, or in other words, to become entwined therewith.

Figure 8:
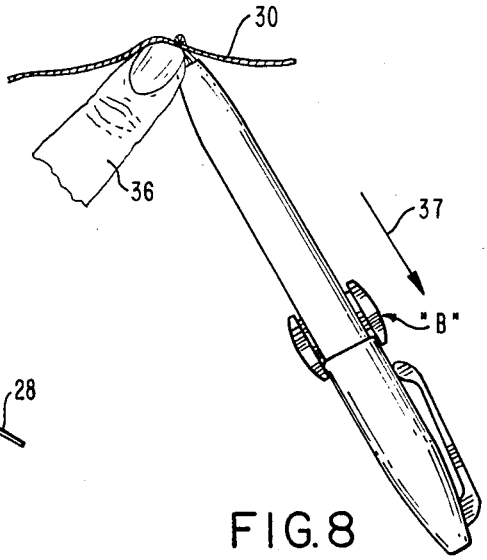

Still pushing against the fabric 30 with finger 36, the extractor 27 is pulled downwardly through the fabric 20 by retracting knob 20 of slide member 17 (arrow 37) back to position "B," as illustrated in FIG. 8. This is to be contrasted with the extended, operable position "A," depicted in previous FIG. 7.

Figure 9:
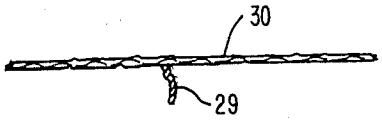

When the extractor 27 is retracted, the snag will be pulled through the fabric 30, such that the snag 29 will now appear below the fabric surface, as shown in FIG. 9.

Figure 10:
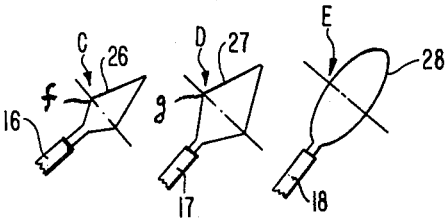
FIG. 10 is a front view of the various wire-looped snag extractors shown in FIG. 2.
Figure 11:
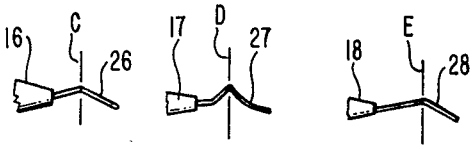
FIG. 11 is a side view of the wired-looped extractors shown in FIG. 10.

FIGS. 10 and 11 show the sizes and shapes of the previously-mentioned extractors 26, 27, and 28, respectively. As aforementioned, wire-loop 26 is useful with finely meshed fabrics, such as silk. It is acutely pointed for this purpose and is made from hardened steel and extends between $\frac{1}{4}$ inch to $\frac{1}{2}$ inch in length and $\frac{1}{8}$ inch to $\frac{1}{4}$ inch in width. The wire diameter for this extractor is approximately 0.008 inch thick.

The extractor 27, which is to be used on medium mesh fabrics, is more diamond-shaped than wire-loop 26, and is of slightly thicker dimension, having a thickness of between 0.008 inch to 0.010 inch.

For heavy or coarse fabrics, such as sweater knits, the extractor 28 is made from wire having a thickness of between 0.010 inch and 0.012 inch. The wire-loop 28 also is more oval-shaped than either of the other two extractors.

Wire loops 27 and 28 have lengths and widths comparable to extractor 26.

In the mid-portion of each wire-loop 26, 27, and 28, there is a transverse bend about axes C, D, and E, respectively, as illustrated in FIGS. 10 and 11. With regard to loops 26 and 27, which are in the shape of a diamond having apexes f and g, the transverse axes C and D must extend through these apexes, and the transverse bends must be about these axes, as shown in FIG.

11. With regard to loop 28, which is oval in shape, the transverse axis E extends across approximately the center of the loop. The transverse bends in loops 26, 27, and 28 about these transverse axes C, D, and E have been found to allow the loops to close more easily, when they pass through the fabric, than if there were no such transverse bends and the loops were planar.

While three extractor loops have been shown in the drawings, it is only by way of explanation and teaching of the invention. The drawings are meant to be exemplary only, and the number of extractors can be reduced or increased, as required, e.g., 2 or 4.

The materials used to construct the device 10 are not critical, and can be made from any suitable material, such as plastic, metal, glass, or wood. In addition, the wire loops can be made of any other materials having the same physical characteristics of steel wire 0.006 to 0.010 inches in thickness and include plastic and spun glass. In the preferred embodiment, music wire of 0.008 to 0.012 inches in thickness is used for best results.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A snag remover device for extracting snags from the surface of a fabric, comprising:

a hollow housing having an opening on a distal end;

a guide member disposed within said housing; and a plurality of spaced-apart slide members respectively disposed for slideable movement relative to said guide member between a respective retracted position and a respective operable position, each slide member having a snag extractor on a distal end thereof, each of said snag extractors protruding from said opening in said housing when its corresponding slide member is disposed in said operable position, but wherein there being only one slide member in an operable position at any one time, and hence, only one snag extractor protruding from said housing opening.

2. The snag remover device of claim 1, wherein said guide member comprises an elongated rod having a plurality of vanes that abut against an inner surface of said housing in order to provide structural support thereto and which define a plurality of guides for guiding said respective snag extractors.

3. The snag remover device of claim 1, wherein each of said snag extractors comprises a wire loop.

4. The snag remover device of claim 1, wherein each snag extractor is structurally different from each of its corresponding extractors.

5. The snag remover device of claim 1, further comprising selector means disposed upon each slide member for operatively sliding each respective slide member between its respective retracted and operable positions.

6. The snag remover device of claim 5, wherein each slide member comprises an elongated rod, and each selector disposed upon its respective slide member comprises a finger-engageable knob.

7. The snag remover device of claim 6, wherein said housing has a plurality of spaced-apart slots, and further wherein each selector knob is respectively slideably disposed in a corresponding slot.

8. The snag remover device of claim 1, wherein said guide member is tapered to a rounded point upon a distal end thereof, and further wherein said point protrudes from said opening in said housing.

9. The snag remover device of claim 1, wherein said hollow housing is shaped like a fountain pen for ease of storage in one's pocket.

10. The snag remover device of claim 3, wherein each wire loop is bent about a mid-portion thereof.

11. The snag remover device of claim 3, wherein one of said wire loops is substantially diamond-shaped.

12. The snag remover device of claim 3, wherein one of said wire loops is substantially oval-shaped.

* * * * *